US006114710A

United States Patent [19]

Contrepois et al.

[11] Patent Number: 6,114,710

[45] Date of Patent: Sep. 5, 2000

[54] TRANSPORT PACKING FOR DANGEROUS PACKAGES SUCH AS HIGH ACTIVITY NUCLEAR PACKAGES

[75] Inventors: Annie Contrepois, Issy-les-Moulineaux; Jean-Claude Argoud, Montbonnot; Camille Bochard, Lyons, all of France

[73] Assignees: Commissariat a l'Energie Atomique, Paris; Robatel, Genas, both of France

[21] Appl. No.: 09/057,692

[22] Filed: Apr. 9, 1998

[30] Foreign Application Priority Data

Apr. 10, 1997 [FR] France ..... 97 04418

[51] Int. Cl.[7] ..... G21F 5/00

[52] U.S. Cl. ..... 250/506.1; 250/507.1

[58] Field of Search ..... 250/506.1, 507.1; 376/272

[56] References Cited

U.S. PATENT DOCUMENTS

| | | | |
|---|---|---|---|
| 4,447,733 | 5/1984 | Baatz et al. | 250/506.1 |
| 4,495,139 | 1/1985 | Janberg et al. | 250/506.1 |

FOREIGN PATENT DOCUMENTS

| | | |
|---|---|---|
| 2 486 701 | 1/1982 | France . |
| 2 649 824 | 1/1991 | France . |
| 2 134 088 | 8/1984 | United Kingdom . |
| 2 166 680 | 5/1986 | United Kingdom . |
| 2 265 675 | 10/1993 | United Kingdom . |

OTHER PUBLICATIONS

Patent Abstracts of Japan, vol. 006, No. 206, Oct. 19, 1982.

Database WPI Section CH, Week 8502, XP 002049428.

*Primary Examiner*—Kiet T. Nguyen

*Attorney, Agent, or Firm*—Eugene Lieberstein; Michael N. Meller

[57] ABSTRACT

Dangerous packages, such as high activity nuclear packages, are placed in adjacent compartments (22) formed in the body (10) of transport packing. The compartments (22) are closed by individually closure plugs (28) and by a common cover (34) that works in cooperation with one face (17) of the body (10) with three seals in series. Connectors installed on the cover (34) and opening up between the seals, are used to make an inspection of the helium confinement. The steel inner casing (24) in each compartment (22) is doubled up on the outside with a copper weld free casing (50). This arrangement significantly improves the confinement inspection, enables a global helium inspection, and if necessary can be used to isolate an unsealed compartment (22).

15 Claims, 4 Drawing Sheets

TRANSPORT PACKING FOR DANGEROUS PACKAGES SUCH AS HIGH ACTIVITY NUCLEAR PACKAGES

TECHNICAL FIELD

This invention relates to packing designed for the transport in complete safety of dangerous packages requiring extreme, safe, reliable and checkable confinement.

The packing according to the invention is particularly suitable for transporting high activity nuclear packages, in which there is some doubt about the seal. However, it may be used to transport dangerous packages of a different nature, particularly derived from chemical industry.

STATE OF PRIOR ART

Nuclear laboratories and plants produce wastes that are classified as a function of their degree of activity, before being transported to their respective storage sites. To facilitate transport and subsequent storage, wastes in each category are conditioned in barrels to form "nuclear packages". The conditions under which the conditioning is done mean that the tightness of the packages is variable and uncertain.

Nuclear packages are usually transported from their production sites to their storage sites in packing, usually called "transport casks" that must provide efficient confinement of the transported nuclear materials and biological protection of persons and the environment. This packing must also have shock and fire resistance to guarantee confinement under all circumstances, in other words particularly in the case of an accident during transport of the packing and if dropped during handling. The packing must also enable efficient elimination of the heat released by nuclear materials.

In practice, nuclear waste is sorted into low, medium and high activity waste, which will be conditioned separately to form three types of nuclear packages. These three types of nuclear packages are transported in different packing, which must satisfy increasingly severe requirements for increasing activity of the transported packages.

Regardless of the type of package being transported, the packing is designed to contain as many packages as possible in order to limit the number of trips between the waste production site and the storage site. Consequently, all packing designed to transport nuclear packages contains several housings, called "compartments", each designed to contain one or two packages.

Furthermore, the outside dimensions of the packing are independent of the nature of the packages being transported and are fixed by the maximum authorized size for transport. The number of compartments and the number of packages that each will contain therefore reduces as the waste activity increases. The thickness of the biological shielding is significantly less for low activity waste than for high activity waste.

For example in the most difficult case of transporting high activity nuclear waste packages, the transport packing usually used has four adjacent compartments, each of which is sized to receive a single nuclear package. These compartments are formed in a cylindrical body consisting mainly of a biological shielding material, coated with a steel casing over its entire outside surface, and on the inside of the compartments. The compartments can all be opened up on the approximately flat top surface of the body and they are usually closed by individual plugs also fitted with a biological shielding material. All the plugs are covered globally by a single cover, fixed removably on the upper surface of the packing body. A cap covers and projects outside the entire upper surface of the body on which the cover was fixed, providing protection against shocks and dissipation of heat.

Confinement in this existing type of packing designed for the transport of high activity nuclear packages is provided mainly by the inner casing in compartments and two adjacent seals that simultaneously surround all plugs and are interposed between the cover over the plugs and the corresponding surface of the packing body.

In an existing package of this type, the confinement is checked by connecting the space located between the seals with vacuum creation means. The variation of the pressure in this space is then monitored for a fairly long time, in order to determine the leakage rate.

This technique for checking the confinement, made necessary by the existing design of the transport packing, has the disadvantage that it is particularly long. Furthermore, when the tightness tests are carried out, it transfers any contamination towards the outside, the amount of which increases for increasing leakage rates.

Furthermore, this current technique for checking the confinement is incapable of detecting a leak in the lower part of the compartments. The lack of any inspection at this level is unfortunate particularly because the inner steel casing which delimits the compartments has a weld which is a possible source of leaks.

Note also that transport packing for high activity nuclear packages is not currently fitted with a bottom shock absorber. Furthermore, picking up devices installed on the outer steel casing of the packing body are located facing the compartments and are relatively rigid. Therefore, it is not absolutely certain that there is no risk of the compartment confinement breaking if the packing drops on one these picking up devices.

DISCLOSURE OF THE INVENTION

The main purpose of the invention is transport packing for dangerous packages, in which the innovative design makes it possible to carry out a fast check of the confinement, while preventing any transfer of contamination towards the outside while the inspection is being made.

According to the invention, this result is obtained using packing for transport of dangerous packages characterized by the fact that it comprises a body delimiting one or more compartments on the inside leading onto the same body surface, with individual closure plugs for each compartment, and a cover covering the plugs and working in conjunction with the said surface by external, intermediate and internal seals that simultaneously surround all plugs, the cover being fitted with a first connector that can be connected to a pressurized tracer gas source and opening up between the inner and intermediate seals, and a second connector that can be connected to means of creating a vacuum and detecting a tracer gas, and connected to the space between the intermediate and outer seals.

This arrangement makes it possible to carry out a fast check of the confinement, without any risk of transferring contamination towards the outside because the space in which the vacuum is created is separated from the compartments by two seals in series.

Furthermore, the presence of three seals in series significantly improves the confinement quality. For example, the limiting leakage rate may be lowered to $10^{-8}$ Pa.m$^3$/s.

In order to improve the global check of the confinement of the compartments, each compartment is preferably delimited by an inner metal casing generally made of steel, comprising at least one weld, doubled up by an outer metal casing generally made of copper.

The double casing thus formed around each compartment may be used to locate the compartment(s) with a defective weld, while the global confinement check carried out using two connectors placed on the cover identifies an unacceptable tightness defect.

The packing body is then equipped on the outside with third connectors that can be connected to a pressurized tracer gas source and pipes connecting each of the third connectors to the outer metal casing of one of the compartments, to open up close to the weld of the inner metal casing. The third connectors are preferably installed on the above mentioned surface of the body beyond the cover.

In this case, special tooling that may be connected to means of creating a vacuum and detecting a tracer gas may be installed instead of the cover. By injecting the tracer gas into each of the third connectors in sequence, it is thus possible to determine the compartment in which the inner metal casing may be defective. This compartment could then be put out of use or repaired, depending on the case.

In order to facilitate dissipation of heat, the outer metal casings, preferably made of copper, and adjacent compartments are connected to each other by sheet metal heat dissipation plates made of the same metal.

In one preferred embodiment of the invention, the confinement is preserved if the packing is dropped or in the case of an accident, by equipping the packing with a removable shock absorbing cover on the above mentioned surface of the body, and a removable shock absorbing bottom on its opposite surface. The removable shock absorbing cover, and the removable shock absorbing bottom are formed at least partly of stacked balsa. They may also comprise progressive honeycomb structures.

The packing body usually is cylindrically shaped, while the compartments are regularly distributed about the center line of the cylinder. Picking up devices for the packing are then preferably installed on one peripheral wall of the body, in planes passing through the center line of the body and located between compartments. This layout prevents compartments from being damaged if the packing should drop on one of the picking up devices.

In order to further reduce this risk, the picking up devices are made to be deformable, by curving them at least partly from the planes in which they are installed.

The above mentioned surface of the packing body is partly formed on a metal flange that surrounds the compartments and on which the cover is fixed. The peripheral wall of the body is also materialized by a metal liner, one edge of which is placed on the above mentioned surface of the body and is connected to the flange by a plate that will deform in the case of shock. This arrangement also contributes to maintaining confinement of the packing if it is dropped or in the case of an accident.

As we have already seen, the packing according to the invention is particularly suitable for transporting high activity nuclear packages, although it can also be used to transport dangerous packages of a different nature, such as packages produced by the chemical industry.

In the application for transporting nuclear packages, the body and the plugs are fitted with a lead biological shielding that fully surrounds the compartments. The biological shielding of the body is then separated from its peripheral wall by a space filled with concrete.

BRIEF DESCRIPTION OF THE DRAWINGS

We will now describe a preferred embodiment of the invention as a non-restrictive example, with reference to the attached drawings, in which.

DETAILED DESCRIPTION OF A PREFERRED EMBODIMENT

Figure 1:
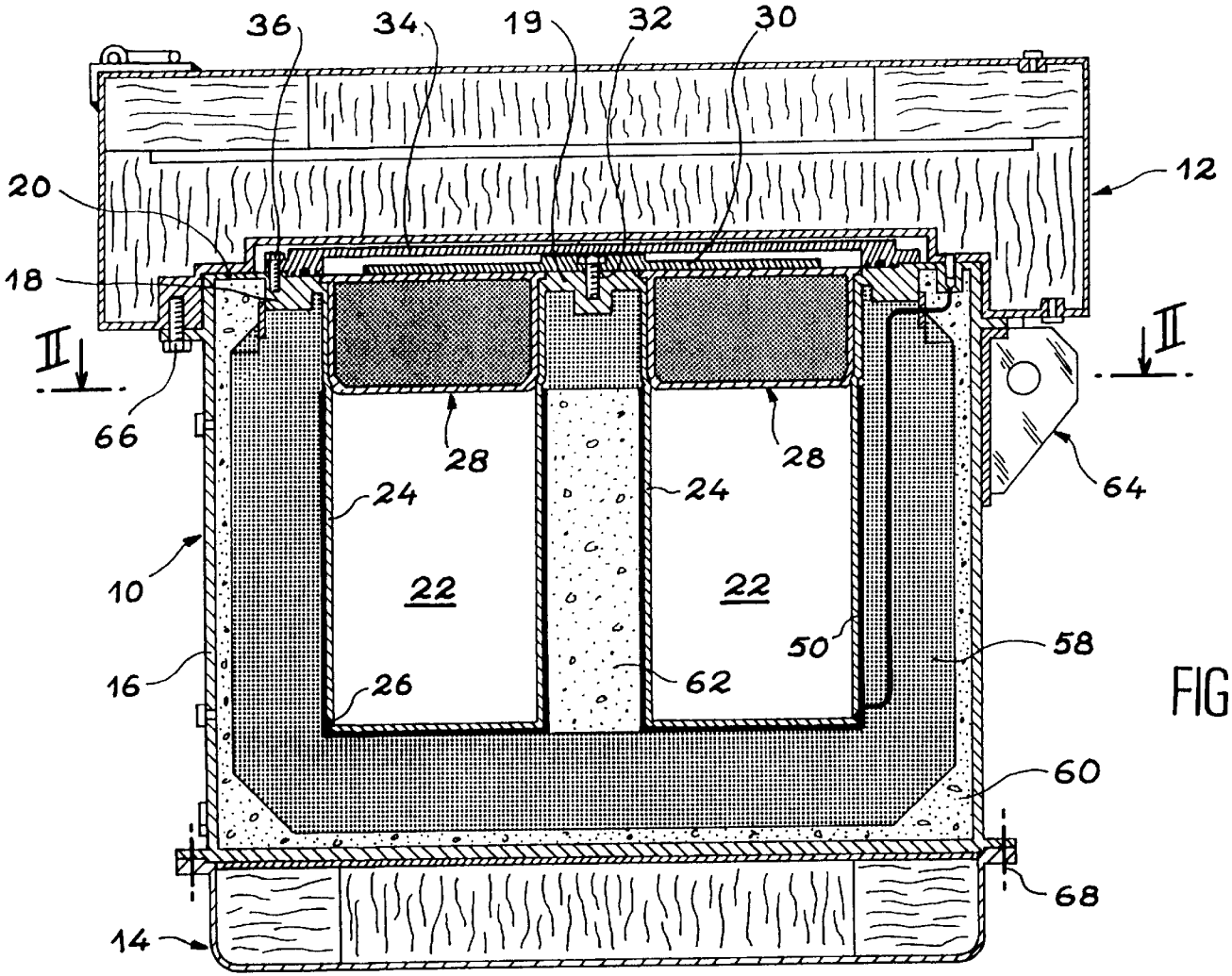
FIG. 1 is a vertical sectional view that schematically shows transport packing according to the invention.
Figure 2:
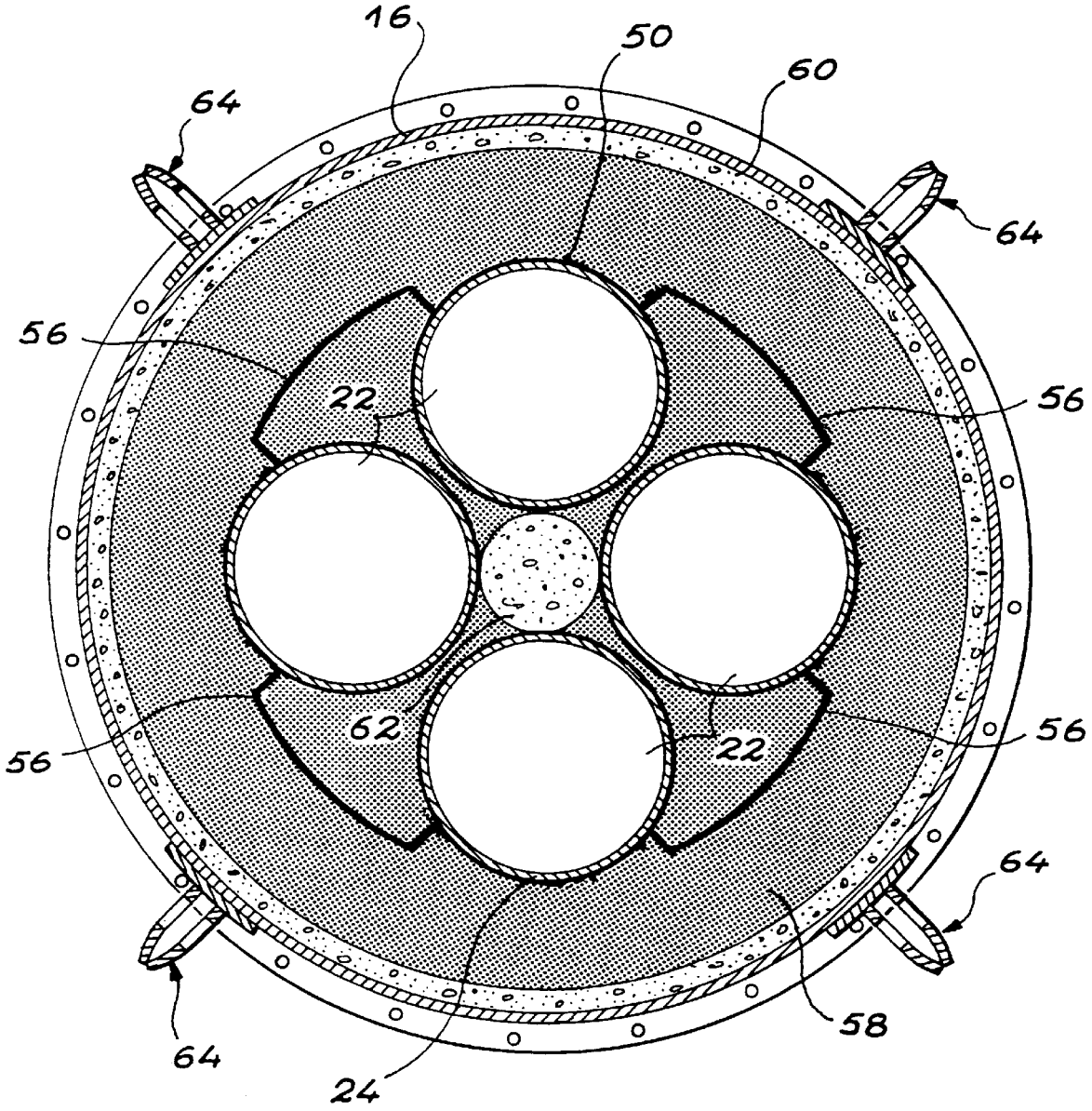
FIG. 2 is a sectional view along line II—II in FIG. 1.

FIGS. 1 and 2 schematically show a preferred embodiment of packing according to the invention, for the transport of high activity nuclear packages. The essential characteristics of this packing may be used to transport other types of dangerous products such as some chemicals, without going outside the scope of the invention.

The transport packing illustrated in FIG. 1 comprises mainly a body 10, a removable shock absorbing cap 12 and a removable shock absorbing bottom 14.

The packing body 10 is in the shape of a cylinder, and the center line of this cylinder will be kept approximately vertical during transport. The peripheral wall and the bottom of the body 10 are materialized by a metallic liner 16 made of welded stainless steel. The approximately plane upper surface 17 of the body 10 is materialized partly by a metal flange 18 also made of stainless steel. The peripheral edge of this flange 18 is separated from the upper edge of the liner 16 and is connected to this edge through a deformable plate 20 also made of welded steel.

The metallic flange 18 encircles a metallic disk 19 which has four circular openings. These openings form access passages to the four adjacent compartments 22 designed to four high activity nuclear package inside body 10.

More precisely, the compartments 22 form cylindrical housings of the same dimensions, the center lines of which are parallel to the center line of the body 10 and are uniformly distributed at the same distance from it as shown in FIG. 2.

Figure 4:
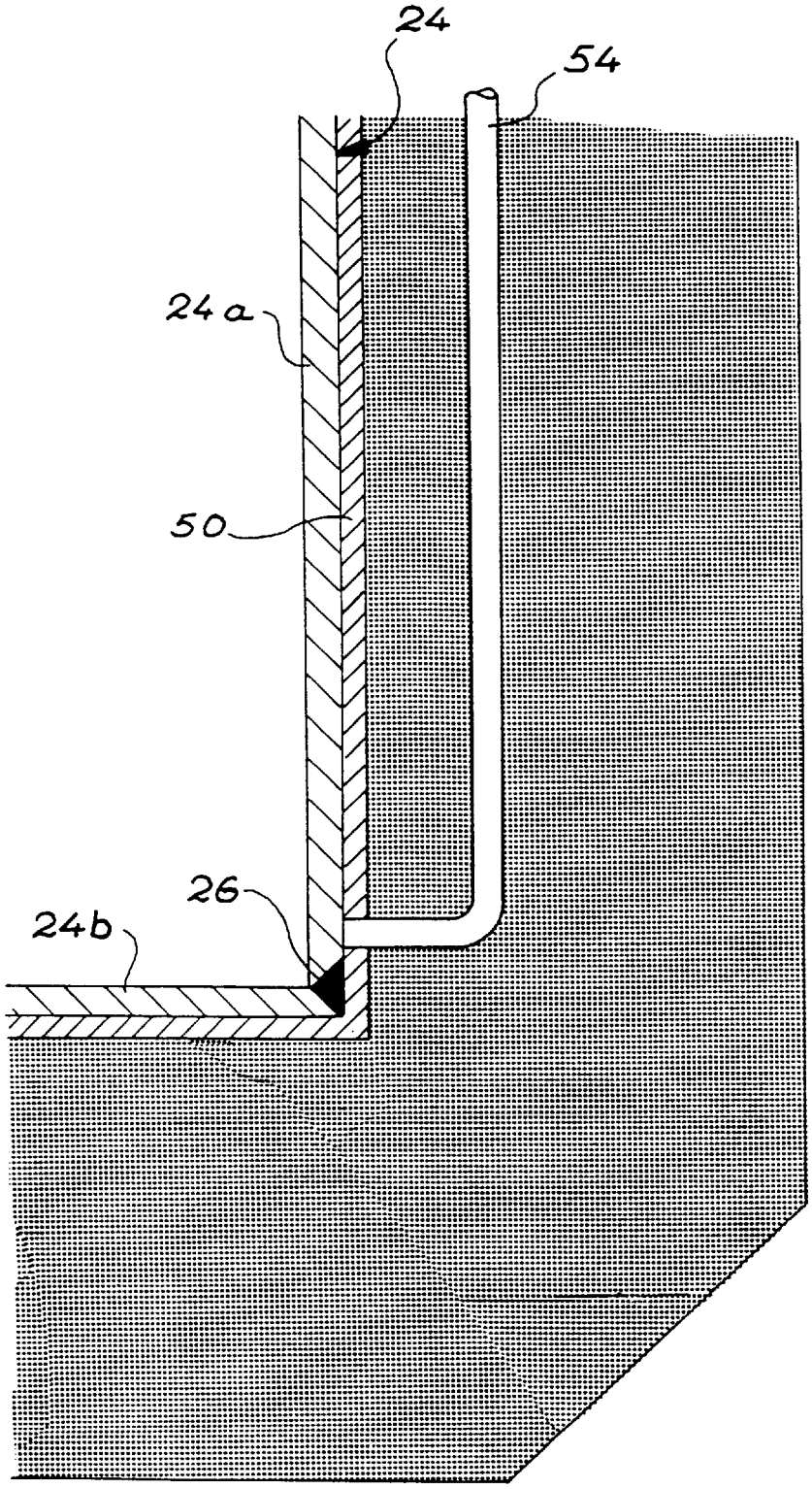
FIG. 4 is a sectional view showing another detailed view of the packing according to the invention.

Each of the compartments 22 is delimited in a sealed manner by an inner metal casing 24 made of stainless steel. This inner metal casing 24 is formed of a peripheral plate 24*a* and a bottom plate 24*b* welded together by a weld 26 (FIG. 4). Furthermore, the upper edge of the peripheral plate of the inner metal casing 24 is welded to disk 19.

Each of the compartments 22 is normally closed by an individual closure plug 28. Each of the plugs 28 is made of a protective material such as lead, coated with stainless steel.

A closing plate 30 is fixed to the central part of disk 19, so as to hold the plugs 28 in their closed positions. In the embodiment shown, the closing plate 30 is fixed onto flange 18 by a screw 32 located along the center line of body 10.

A cover 34 covers all plugs 28 and the closing plate 30 on the upper surface of body 10. More precisely (FIG. 3), the cover 34 is fixed by screws 36 on the flange 18 materializing the upper surface 17 of body 10, and it cooperates with this surface 17 to form a seal by means of three concentric circular seals which simultaneously encircle all plugs 28, to provide global confinement of compartments 22. Screws 36 are located outside the seals, with respect to the center line of body 10.

Figure 3:
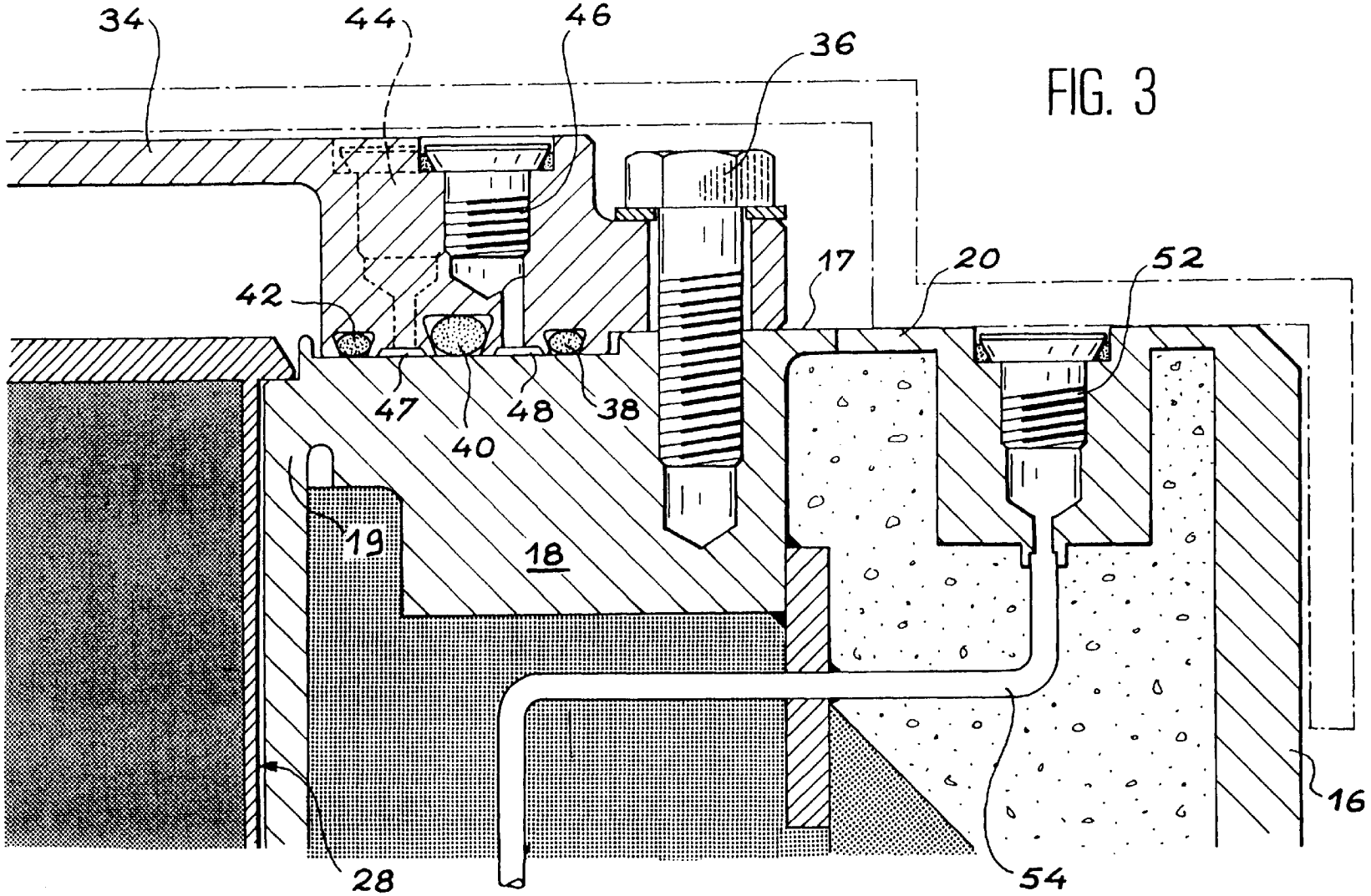
FIG. 3 is a larger scale view showing details of the packing.

As shown in more detail in FIG. 3, the three seals consist of an external seal 38, an intermediate seal 40 and an inside seal 42. Seals 38, 40 and 42 are O-rings that fit into concentric grooves formed on the surface of the cover 34 designed to be placed in contact with the upper surface 17 of the body 10.

The cover 34 has a first connector 44 accessible on its upper surface and which opens up into an annular space 47 formed between the inner seal 42 and the intermediate seal 40. This first connector 44 is designed to be connected to an outside source (not shown) of a pressurized tracer gas such as helium.

The cover 34 also has a second connector 46 accessible from its upper surface, which opens up into an annular space 48 defined between the intermediate seal 40 and the outer seal 38. This second connector 37 is designed to be connected to outside means (not shown) for creating a vacuum in the annular space 48 and for detecting tracer gases.

In its part located below the individual closure plug 28 for each compartment 22, the inner metal casing 24 is doubled up by an outer metal casing 50 made of copper. The presence of this outer metal casing 50 significantly improves the check on the confinement of the packages, compared with existing types of packing. The outer metal casing 50 can also detect a leak in the metal casing 24, for example at weld 26, by means of external devices connected to connectors 44 and 46. In particular, the presence of the outer metal casing 50 helps to determine which of the compartment(s) is (are) defective.

Consequently, four third connectors 52 are placed on the upper surface of the body 10 beyond the peripheral edge of cover 34, for example on the deformable plate 20. Each of these connectors 52 is installed at a first end of a pipe 34, the opposite end of which is connected to the outer metal casing 50 of the corresponding compartment 22, opening up between this outer metal casing and inner metal casing 24, close to the weld 26 (FIG. 4).

Each of the third connectors 52 is designed to be connected to an outside source (not shown) of a pressurized tracer gas such as helium.

As we will describe in more detail later, when it is required to localize a defective compartment 22 using the third connectors 52, the cover 34 is replaced by a special tooling (not shown) that does not form part of the packing. This tooling is composed of a part similar to cover 34, connected to outside means (not shown) of creating a vacuum in compartments 22 and for detecting the tracer gas.

As shown particularly in FIG. 2, the outer metal casings 50 made of copper, and adjacent compartments 22 are connected in pairs by metal heat dissipation plates 56. Like the casings 50, these plates 56 are preferably made of copper. They extend over the entire height of the outer metal casings 50 and are located approximately on a cylinder with the same center line as the packing body 10, and tangent on the outside to casings 50. Plates 56 facilitate dissipation towards the outside of the packing, of heat dissipated by high activity nuclear packages contained in compartments 22.

As shown particularly in FIGS. 1 and 2, the packing body 10 comprises biological shielding 58 made of lead that fully surrounds the periphery of the compartments and the bottom of body 10. This biological shielding 58 is separated from the metal liner 16 which materializes the peripheral wall and the bottom surface of body 10, by a space filled with concrete 60. The central part of the body 10 also comprises a concrete kernel 62 in the region located between compartments 22.

Four packing picking up devices 64 are installed on the annular part of the metal liner 16, materializing the peripheral wall of body 10. As shown in FIG. 2, these picking up devices 64 are placed in the planes passing through the center line of the body 10 and located between adjacent compartments 22. If the packing drops on one of the picking up devices 64, this arrangement means that the confinement of compartments 22 will not be broken.

Furthermore, each of the picking up devices 64 is formed of two separate metal plates parallel to the plane mentioned above, in which the end parts turned towards the outside are partially folded towards each other with respect to this plane to be welded to each other at their ends. This configuration accelerates the deformation of picking up devices 64 if the packing drops. Therefore it also contributes to eliminating any risks of breaking the confinement of compartments 22.

As shown in FIG. 1, the removable shock absorbing cap 12 is designed to be fixed onto the body 10 by screws 66. More precisely, screws 66 pass through a flange formed on the metal liner 16 close to its top end, and are screwed to an outer metal casing of cap 12. The outer casing of the removable shock absorbing cap 12 is filled with stacked balsa. This structure enables the cap to absorb shocks by deforming.

The shock absorbing bottom 14 is fixed removably under the bottom of body 10, for example by means of bolts 68. More precisely, bolts 68 simultaneously pass through a flange formed in the bottom of the metal liner 16 and a flange formed in the top of the shock absorbing bottom 14.

Furthermore, the removable shock absorbing bottom 14 is connected in approximately the same manner as the removable shock absorbing cover 12. Thus, it is composed mainly of a stack of balsa enclosed in an outer metal casing.

Note that as a variant, part of the balsa in which the cap 12 and the bottom 14 are formed, may be replaced by progressive honeycomb structures.

The bottom 14 also performs a shock absorbing function.

When it is required to use the transport packing described above, the cap 12, the cover 34, the support plate 30 and the individual plugs 28 are disassembled in turn. One of the high activity nuclear packages to be transported is then placed in each of the compartments 22.

When the four compartments 22 are filled, the individual plugs 28, the support plate 30 and the cover 34 are put back into position.

The tightness of the intermediate seal 40 is then checked by connecting the first connector 44 to a pressurized helium source and connecting the second connector 46 to a circuit comprising means of creating a vacuum in the annular space 48, and means of detecting helium. Thus, a fast measurement of the leakage rate can be obtained representative of the quality of the obtained confinement.

If there are no particular problems, the leakage rate obtained using the packing conform with the invention is about $10^{-8}$ Pa.m$^3$/s.

If the value of the measured leakage rate is less than or equal to a limit fixed by the regulations (currently equal to $10^{-7}$ Pa.m$^3$/s) the checking apparatus is removed and the removable shock absorbing cap 12 is put into position. The packing may then be transported.

If the helium leak test is unsatisfactory despite several successive disassembly and cleaning operations of the surfaces forming the seal between the cover 34 and the body 10, the cover 34, the support plate 30 and plugs 28 are disassembled, and compartments 22 are emptied.

The special tooling used to create a vacuum simultaneously in all compartments 22 is then placed on the empty body 10. When the required vacuum is obtained, each of the connectors 52 is connected to a helium source in turn in order to determine which of the inner metal casings 24 are not sealed.

When the leak or leaks have been identified, it may be decided either to use the packing partially by leaving the unsealed compartment(s) empty, or to repair the defective weld(s).

If it is decided to repair the welds, the repair may be made either inside or outside the compartment. If it is to be done from the outside, the packing will have to be almost entirely disassembled.

During transport, note that the addition of removable shock absorbing cap 12 and the removable shock absorbing bottom 14 can protect the confinement of the compartments under all accident circumstances. Furthermore, the packing body 10 can usually be reused if it is dropped, by replacing the cap and/or bottom damaged by the drop.

Note that if it is dropped, the plate 20 can deform and thus contribute to maintaining the confinement of compartments 22.

Furthermore and as already described, the shape and arrangement of the picking up devices 64 also help to prevent any risks of breaking the confinement of compartments 22 if the packing should drop on one of these devices.

Obviously, the invention is not restricted to the embodiment that has just been described. In particular, the transport packing according to the invention may be used to transport all types of dangerous packages other than high activity nuclear packages. In this case, the biological shielding of body 10 and plugs 28 may be eliminated or modified.

What is claimed is:

1. Packing device for transport of dangerous packages comprising a body delimiting at least one inside compartment opening onto one face of said body, an individual closure plug adapted to close each compartment, and a cover covering the plugs and working in conjunction with said face by external, intermediate and internal seals that simultaneously surround all plugs, the cover being fitted with a first connector adapted to be connected to a pressurized tracer gas source and opening up between the inner and intermediate seals, and a second connector adapted to be connected to means of creating a vacuum and detecting a tracer gas, and open into a space between the intermediate and external seals.

2. Packing device according to claim 1, in which each compartment is delimited by an inner metal casing comprising at least one weld, together with an outer metal casing.

3. Packing device according to claim 2, in which the body is equipped by third outside connectors adapted to be connected to a source of pressurized tracer gas, pipes connecting each of the third outside connectors to the outer metal casing around one of the compartments, leading close to said weld.

4. Packing device according to claim 3, in which each of the third outside connectors are mounted on said face of the body above the cover.

5. Packing device according to claim 3, in which a special tooling adapted to be connected to pressurization and tracer gas detection means, replaces the cover.

6. Packing device according to claim 2, in which the outer metal casings of adjacent compartments are connected to each other by heat dissipation plates.

7. Packing device according to claim 6, in which the outer metal casings and the heat dissipation plates are made of copper.

8. Packing device according to claim 1, in which a removable shock absorbing cap and a removable shock absorbing bottom are installed on said face and on another face of the body, opposite to said one face, respectively.

9. Packing device according to claim 8, in which the removable shock absorbing cap and the removable shock absorbing bottom are formed at least partly of stacked balsa.

10. Packing device according to claim 9, in which the removable shock absorbing cap and the removable shock absorbing bottom also include progressive honeycomb structures.

11. Packing device according to claim 1, in which the shape of the body is cylindrical with the compartments being uniformly distributed around a center line of this cylindrical shape, and in which packing picking up devices are mounted on a peripheral wall of the body, in planes passing through said center line and located between the compartments.

12. Packing device according to claim 11, in which the picking up devices are at least partially curved with respect to the planes on which they are mounted.

13. Packing device according to claim 11, in which the said one face of the body is formed partly on a metal flange that surrounds the compartments and on which the cover is fixed, a peripheral wall of the body being materialized by a metal liner, one edge of which, placed on said one face of the body, is connected to the flange by a deformable plate.

14. Packing device according to claim 11, in which the body and the plugs include biological shielding that completely surrounds the compartments, the biological shielding of the body being separated from a peripheral wall of said body by a space filled with concrete.

15. Packing device according to claim 1, said packing device being applied to the transport of high activity nuclear packages.

* * * * *